US006887107B2

(12) United States Patent
Ohsumi

(10) Patent No.: US 6,887,107 B2
(45) Date of Patent: May 3, 2005

(54) CONNECTING STRUCTURE OF ELECTRIC BULB

(75) Inventor: Hideki Ohsumi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/438,904

(22) Filed: May 16, 2003

(65) Prior Publication Data

US 2003/0232544 A1 Dec. 18, 2003

(30) Foreign Application Priority Data

May 17, 2002 (JP) ..... P2002-142721

(51) Int. Cl.[7] ..... H01R 17/00
(52) U.S. Cl. ..... 439/617; 313/318.05
(58) Field of Search ..... 439/918, 617, 439/618; 313/318.05

(56) References Cited

U.S. PATENT DOCUMENTS 2,627,048 A * 1/1953 Lamb ..... 313/318.05
4,100,448 A * 7/1978 Chipner et al. ..... 313/318.11
4,427,255 A * 1/1984 Cox ..... 439/548
4,500,946 A * 2/1985 Mikola ..... 362/226
4,547,838 A * 10/1985 Wakimizu ..... 362/211
4,804,343 A * 2/1989 Reedy ..... 439/854
4,826,443 A * 5/1989 Lockard ..... 439/101

FOREIGN PATENT DOCUMENTS

JP 5-55487 7/1993
JP 9-55272 2/1997

* cited by examiner

*Primary Examiner*—Neil Abrams
(74) *Attorney, Agent, or Firm*—Armstrong, Kratz, Quintos, Hanson & Brooks, LLP

(57) ABSTRACT

A connecting structure of an electric bulb includes a socket, in which the electric bulb is mounted, and a connector having a terminal received therein. The connecting structure also includes, fitting into the socket, a first lead wire and a second lead wire connected respectively to both ends of a first filament of the electric bulb, and terminal portions, formed respectively at extension portions of the first lead wire and the second lead wire which extend outwardly from the electric bulb. The terminal portions are connected to the terminals respectively when the socket is fitted on the connector. When an inner wall of the socket abuts against a front wall of the connector, an electrically-connected condition of each terminal portion and the corresponding terminal is maintained, and a power source and the bulb are electrically connected together, so that the bulb is lighted. The connecting structure may include more than one filament in the bulb.

10 Claims, 8 Drawing Sheets

CONNECTING STRUCTURE OF ELECTRIC BULB

BACKGROUND OF THE INVENTION

This invention relates to a connecting structure of bulb used in a headlamp of, a tail lamp and meters of a vehicle.

So-called wedge base-type bulbs, having no metal base, have been extensively used as electric bulbs serving as a light source for a headlamp, a tail lamp and meters. Such bulbs have now become a mainstream. A base portion of the wedge base-type bulb is inserted into a socket, and this socket is connected to a mating connector or the like, so that the wedge base-type bulb is supplied with electric power from a battery.

The wedge base-type bulb is not provided with a metal base, and therefore lead wires, connected to filaments, are connected to relay terminals provided in the socket, and these relay terminals are connected respectively to terminals received in the connector, thereby forming an illumination circuit. FIG. 7 shows one such known connecting structure of bulb disclosed in JP-A-9-55272.

As shown in the drawing, an electric bulb 100 is a wedge base-type bulb 100 having two filaments 101. The bulb 100 has a generally-flattened base portion 103 formed at a lower end of a silica glass tube 102, and lead wires 104 extend outwardly through the lower end of the base portion 103. End portions of the lead wires 104 are directed away from each other in a direction of a thickness of the base portion 103, and are folded back toward the silica glass tube 102 to extend respectively along opposite sides of the base portion 103 to form contact piece portions 104*a*, respectively.

A socket 105 includes a socket body 106, and relay terminals 109. The socket body 106 has a bulb mounting portion 107 having an opening for mounting the bulb 100 therein. Relay terminals 109 are mounted on an inner face of the bulb mounting portion 107. Terminal portions 109*a* of the relay terminals 109 are connected respectively to terminals of a connector (not shown) to supply electric power from a battery (not shown) to the bulb 100.

When the bulb 100 is mounted on the bulb mounting portion 107, retaining portions 103*a* on the base portion 103 are engaged respectively with resilient retaining pieces 108 formed on the bulb mounting portion 107, thereby preventing the bulb 100 from withdrawal from the socket 105. The base portion 103 is sandwiched between the relay terminals 109, and at the same time the contact piece portions 104*a* contact the relay terminals 109, respectively.

However, the above related connecting structure of bulb has the following problems to be solved.

Firstly, the lead wires 104, extending outwardly through the lower end of the base portion 103, must be folded back toward the silica glass tube 102 to form the contact piece portions 104*a*, and therefore there is a problem that additional time and labor are required for processing the end portions of the lead wires 104.

And besides, the structure of the socket 105 is complicated since this socket 105 includes the socket body 106 and the relay terminals 109. There is a problem that the cost increases. The relay terminals 109 are not fixed to the inner face of the bulb mounting portion 107, but are merely disposed along this inner face, and therefore there is a fear that the relay terminals 109 are disengaged from the bulb mounting portion.

Furthermore, the socket 105 has the relay terminals 109, and therefore there is a problem that the number of contacts increases, so that the reliability of electrical contact of the contacts is lowered. Namely, the supply of electric power from the battery to the bulb 100 is effected via the relay terminals 109, and therefore there are provided the two contacts, and if one of the two contacts should be incompletely contacted, the bulb 100 can not be lighted.

SUMMARY OF THE INVENTION

It is therefore an object of the present invention to provide a connecting structure of bulb in which the number of component parts of a socket is reduced, thereby reducing the cost, and besides the number of contacts is reduced, thereby enhancing the reliability of electrical connection of the contact.

In order to achieve the above object, according to the present invention, there is provided a connecting structure of an electric bulb comprising:

a socket, in which the electric bulb is mounted;

a connector, having a terminal received therein, and fitting into the socket;

a first lead wire and a second lead wire, connected respectively to both ends of a first filament of the electric bulb; and terminal portions, formed respectively at extension portions of the first lead wire and the second lead wire which extend outwardly from the electric bulb, wherein the terminal portions are connected to the terminals respectively when the socket is fitted on the connector.

In the above construction, the lead wires are electrically connected directly to the respective terminals of the connector without the use of any relay terminal. Therefore, the structure of the socket is simplified, and the number of the component parts of the socket is reduced, and the cost is reduced, and besides the molding of the socket can be effected easily. Furthermore, the number of the contacts is reduced, so that the reliability of electrical connection of the contacts is enhanced.

Preferably, the socket includes a bulb mounting portion for mounting the bulb therein, and a connector fitting portion for fitting on the connector.

In the above construction, the socket includes the bulb mounting portion, and the connector fitting portion, however, the socked does not have any relay terminal. Therefore the bulb is held by the connector through the socket, and also the structure of the socket is simplified, so that the molding of the socket can be effected easily.

Preferably, the bulb further includes a second filament, and a third lead wire and a fourth lead wire are connected respectively to both ends of the second filament of the electric bulb, and the second lead wire and the fourth lead wire are connected respectively to a negative electrode of a power source, and the second lead wire and the fourth lead wire are directly connected each other.

In the above construction, the second lead wire and the fourth lead wire for connection to the negative electrode of the power source are directly connected together. Therefore, the terminal portions of the lead wires for connection to the connector can be formed as three poles, and the bulb, having the two filaments, can be directly connected to the three-pole connector having the three terminals (three poles), and it is not necessary to use any relay terminal. Therefore, the cost can be reduced by reducing the number of the component parts of the socket. And besides, the reliability of electrical connection of the contacts can be enhanced by reducing the number of the contacts.

Preferably, a conductive portion is formed in the socket, and the bulb further includes a second filament, and a third lead wire and a fourth lead wire are connected respectively to both ends of the second filament of the electric bulb, and the second lead wire and the fourth lead wire are connected respectively to a negative electrode of a power source, and the second lead wire and the fourth lead wire are electrically connected through the conductive portion.

In the above construction, the second lead wire and the fourth lead wire for connection to the negative electrode of the power source are connected together through the conductive portion formed at the socket, and therefore it is not necessary to beforehand contact the two lead wires with each other to electrically connect them together, and merely by mounting the bulb in the socket, the three terminal portions (three poles) can be formed. Therefore the reliability of electrical connection of the contacts is further enhanced.

Preferably, the bulb further includes a second filament, and a third lead wire and a fourth lead wire are connected respectively to both ends of the second filament of the electric bulb, and the second lead wire and the fourth lead wire are connected respectively to a negative electrode of a power source, and the second lead wire and the fourth lead wire are formed by a single lead wire.

Preferably, a retaining portion is provided at a base portion of the bulb from which the lead wires extend outwardly, and an engagement portion is provided at the socket, and the engagement portion is engaged with the retaining portion so that the bulb is held in the socket.

In the above construction, the retaining portion is provided at the base portion of the bulb, and the engagement portion for engagement with the retaining portion is provided at the socket. Therefore, the bulb, mounted in the socket, is prevented from being withdrawn rearwardly therefrom, so that the electrically-connected condition of the bulb is maintained.

Preferably, a retaining portion is provided at the socket, and a engagement portion is provided at the connector, and the engagement portion is engaged with the retaining portion so that the socket and the connector are held in the fitted condition.

In the above construction, the retaining portion is provided at the socket, and the engagement portion is provided at the connector. Therefore, the socket and the connector are prevented from being accidentally disengaged from each other, so that the fitted condition of the socket and the connector is maintained.

Preferably, at least one of the first lead wire and the second lead wire is folded back so as to superpose folded portions thereof.

Here, it is preferable that at least one of the third lead wire and the fourth lead wire is folded back so as to superpose folded portions thereof.

In the above configurations, the strength of the lead wire increases, thereby preventing the terminal portion of the lead wire from being accidentally deflected or bent.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of the present invention will now be described in detail with reference to the drawings.

Figure 1:
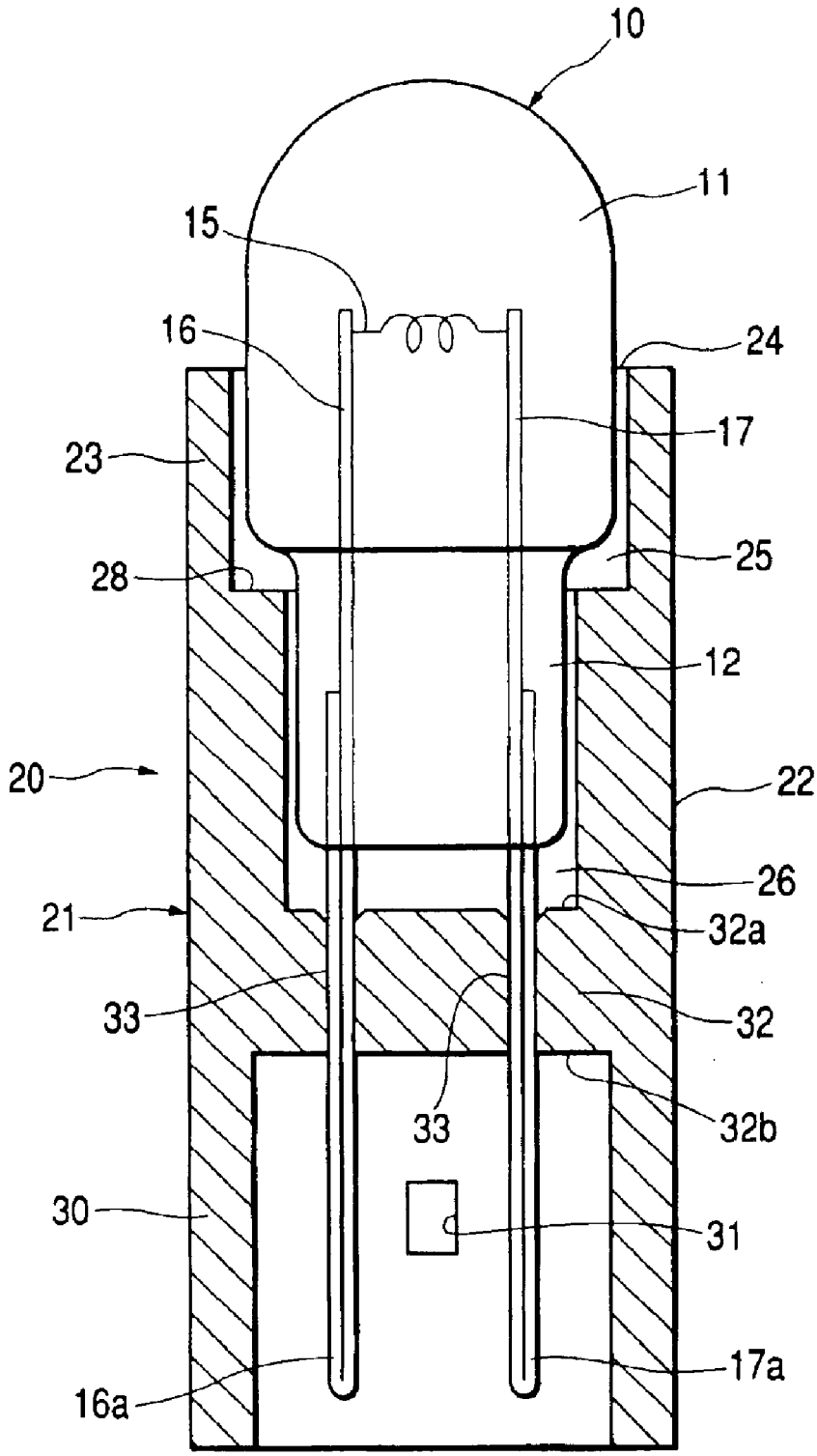
FIG. 1 shows a connecting structure of bulb according to a first embodiment of the present invention, and is a cross-sectional view of a socket in which a bulb is mounted.
Figure 2:
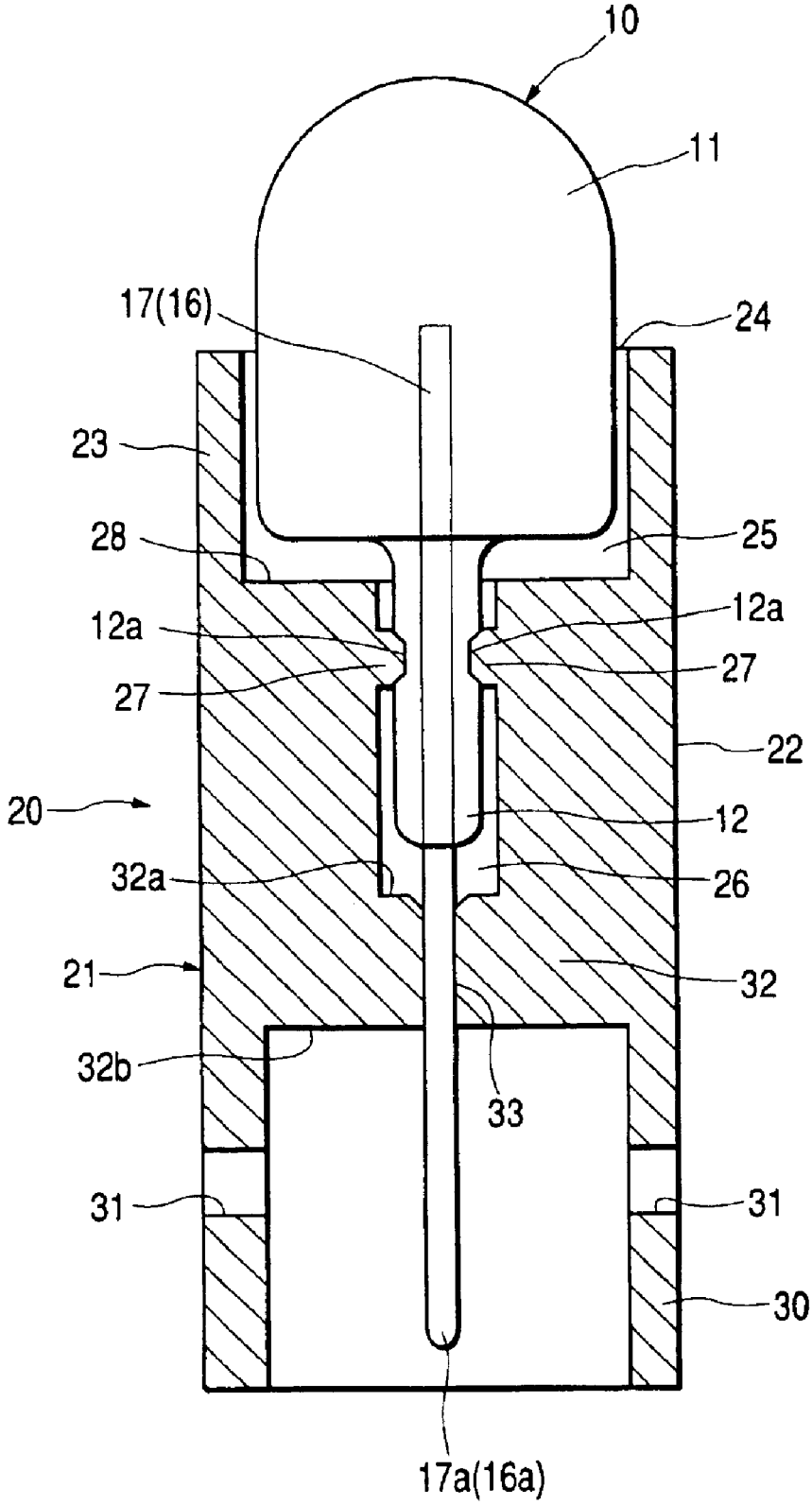
FIG. 2 is a cross-sectional view of the socket shown from a different direction.

FIGS. 1 and 2 show the first embodiment of an connecting structure of bulb of the invention.

As shown in FIG. 1, a socket 20 to which an electric bulb 10 is attached includes a tubular socket body 21 made of a synthetic resin. The socket body 21 is injection molded into an integral construction. The socket body 21 has a bulb mounting portion 23 formed at one end portion thereof in a bulb fitting direction, and also has a connector fitting portion 30 at the other end portion thereof. The bulb mounting portion 23 and the connector fitting portion 30 are integrally connected together through a partition wall 32 serving as an inner wall.

The bulb mounting portion 23 has an opening 24 for mounting the bulb 10 therein, and also has a larger hole portion 25, disposed immediately adjacent to the opening 24, and a smaller hole portion 26 disposed at an inner side thereof. The larger hole portion 25 and the smaller hole portion 26 are separated by a step portion 28 formed at the boundary therebetween. A lower half portion of a silica glass tube 11 of the bulb 10 is held in the larger hole portion 25, and a base portion 12 of the bulb 10 is held in the smaller hole portion 26. Only the smaller hole portion 26 may be provided without providing the larger hole portion 25. However, by providing the larger hole portion 25 surrounding the lower half portion of the silica glass tube 11, the silica glass portion 11 is protected from external interference so that the bulb 10 is prevented from damage or the like.

The larger hole portion 25 is so sized that a gap is formed between this larger hole portion 25 and the silica glass tube 11 of the bulb 10. The smaller hole portion 26 is so sized that a gap is formed between this smaller hole portion 26 and the base portion 12 of the bulb 10. By thus forming each of the larger hole portion 25 and the smaller hole portion 25, with the small gap formed between it and the associated portion, the mounting of the bulb 10 on the bulb mounting portion 23 can be effected smoothly.

As shown in FIG. 2, a pair of opposed projections (engagement portions) 27 are formed on an inner face of the smaller hole portion 26. The pair of projections 27 are engaged respectively in recesses (retaining portions) 12*a* formed in the base portion 12 of the bulb 10, thereby preventing the withdrawal of the bulb 10. Each projection 27 is formed into a generally semi-spherical shape, and therefore can be easily engaged in the base portion 12, and besides when exchanging the bulb 10 because of lifetime cutting of a filament 15 of the bulb 10, the bulb 10 can be removed easily. Instead of the projections 27, recesses (not shown) may be formed in the inner face of the smaller hole portion 26, while projections (not shown) may be formed on the base portion 12 of the bulb 10. Alternatively, spring pieces may be provided on the smaller hole portion 26 so as to hold the base portion 12 therebetween.

Referring again to FIG. 1, the partition wall 32 is provided in continuous relation to the smaller hole portion 26. Therefore, one side face 32*a* of the partition wall 32 serves as an inner end face of the smaller hole portion 26. The other side face 32*b* of the partition wall 32 serves as an inner end face of the connector fitting portion 30. Passage holes 33 are formed through the partition wall 32, and lead wires 16 and 17, extending outwardly from the bulb 10, pass through these passage holes 33, respectively. The lead wires 16 and 17, passing respectively through the passage holes 33, are guided and supported by inner faces of these passage holes 33, and extend straight relative to a connector 35 (FIG. 3).

The diameter (bore) of the passage holes 33 is generally equal to the thickness (diameter) of the lead wires 16 and 17. If the diameter of the passage holes 33 is large than the thickness of the lead wires 16 and 17, the lead wire 16, 17 plays in the passage hole 33, so that the lead wire 16, 17 can shake. On the other hand, if the diameter of the passage holes 33 is smaller than the thickness of the lead wires 16 and 17, the lead wire 16, 17 can not be passed through the passage hole 33.

The partition wall 32 is molded into a larger thickness as compared with a peripheral wall 22 of the socket body 21. This is adopted in order to guide and support the lead wires 16 and 17 (which are thin, and are liable to be bent) to suppress the bending of the lead wires 16 and 17. The partition wall 32 is disposed close to the base portion 12 of the bulb 10, and therefore the bending of the lead wires 16 and 17, extending outwardly from the base portion 12, is effectively suppressed.

Figure 3:
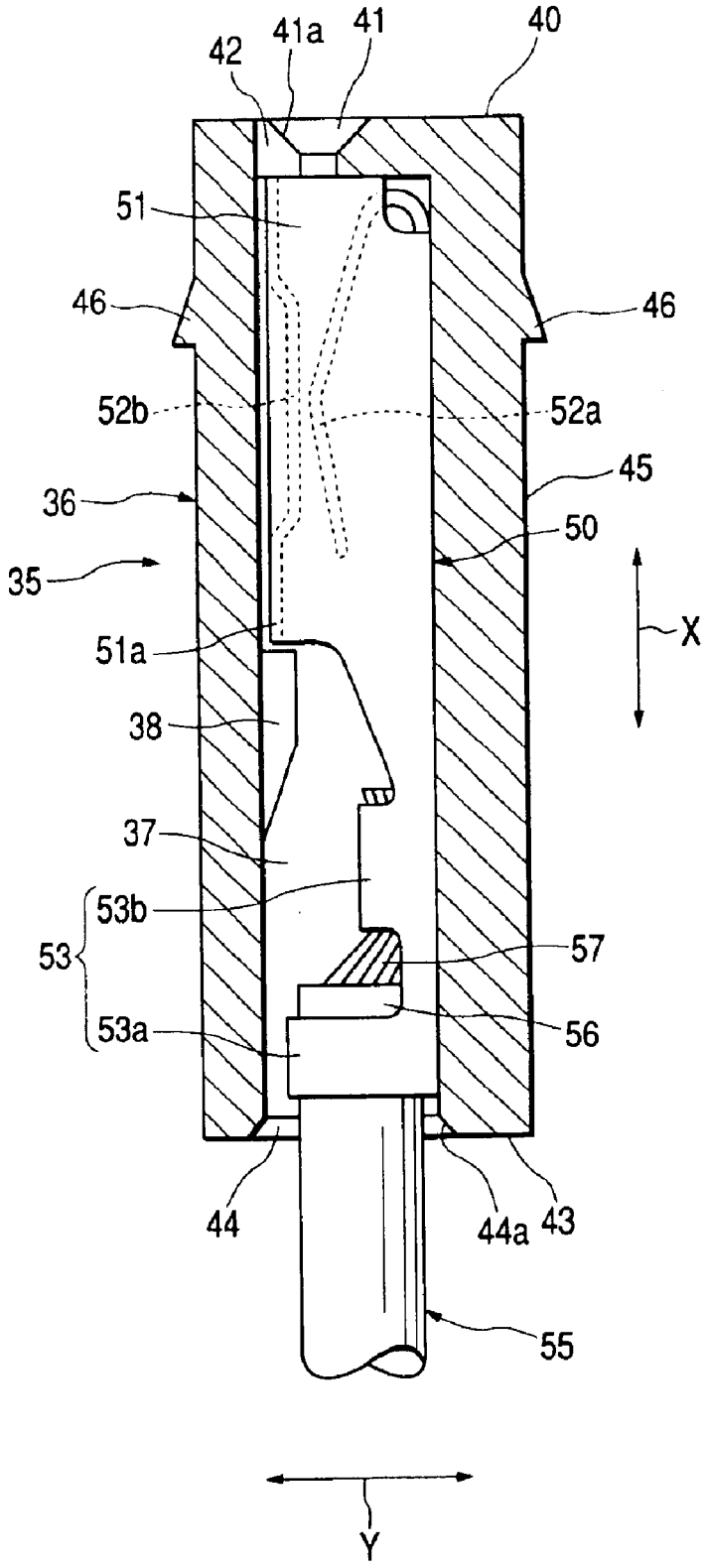
FIG. 3 is a cross-sectional view of a mating connector for fitting into the socket of FIG. 1.

The connector fitting portion 30 forms a so-called female fitting portion for the mating connector 35 (FIG. 3). On the other hand, a male-type fitting portion is formed at the connector 35, and the two fitting portions are so sized as to be snugly fitted together. Each of the passage holes 33 is open at its one end to an inner end face of the connector fitting portion 33.

As shown in FIG. 2, retaining holes (retaining portions) 31 are formed in a wall portion of the connector fitting portion 30. These retaining holes 31 are engaged respectively with retaining claws (engagement portions) 46 formed on the connector 35 (FIG. 3), thereby maintaining a fitted condition of the socket 20 and the connector 35. In contrast, retaining claws (not shown) may be formed on the inner face of the connector fitting portion 30, while retaining holes (not shown) for engagement with the respective retaining claws may be formed in the connector 35.

Alternatively, retaining holes (retaining portions) (not shown) may be formed in the wall portion of the connector fitting portion 30, and elastic lock arms (engagement portions) (not shown) each having retaining projection may be formed on the connector 35. With this retaining structure, the socket 20 and the connector 35 can be more smoothly fitted together and disengaged from each other.

Terminal portions 16*a* and 17*a*, formed respectively by extension portions of the lead wires 16 and 17, do not project outwardly from the connector fitting portion 30, but are disposed within the connector fitting portion 30. Therefore, the lead wires 16 and 17 are protected by the wall portion of the connector fitting portion 30, and are protected from accidental external interference.

The bulb 10 includes the silica glass tube 11, the base portion 12 extending from the lower end of the silica glass tube 11, and the filament 15 (FIG. 1) sealed in the silica glass tube 11. The silica glass tube 11 has a generally hemispherical upper half portion and the cylindrical lower half portion, and is formed into an integral construction, and this upper half portion is exposed to the exterior of the bulb mounting portion 23. Light, emitted from the filament 15, illuminates the exterior, or illuminates a needle (pointer) of a meter (not shown) or the like.

The base portion 12 serves as the mounting portion for the socket 20, and is formed into a flattened shape. The lead wires 16 and 17, connected to the filament 15, pass through the base portion 12, and further extend straight downwardly.

Referring back to FIG. 1, the filament 15 is horizontally supported by the lead wires 16 and 17 within the silica glass tube 11 filled with inert gas such as nitrogen or argon, the filament 15 being disposed at an intermediate portion of the silica glass tube 11. The inert gas is thus filled in order to prevent the filament, composed of tungsten or the like, from reacting with oxygen, thereby preventing the evaporation of the filament.

One ends of the lead wires 16 and 17 are connected to both ends of the filament 15, respectively, and the other end portions of the lead wires 16 and 17 extend outwardly from the base portion 12 of the bulb 10, and further extend straight downwardly. The terminal portions 16*a* and 17*a* are formed respectively at the extension portions of the lead wires 16 and 17 extending outwardly from the base portion 12. The terminal portions 16*a* and 17*a* are electrically connected respectively to so-called female-type terminals 50 in the connector 35 (FIG. 3) so that electric power can be supplied to the filament 15 from a battery (not shown).

The terminal portions 16*a* and 17*a* are formed respectively at distal end portions of the folded-back portions of the lead wires 16 and 17. By thus folding back each lead wire 16, 17, the strength of the terminal portion 16*a*, 17*a* increases, thereby preventing the terminal portion from being accidentally deflected or bent.

As shown in FIG. 3, the connector 35 for fitting into the socket 20 includes a connector housing 36 made of a synthetic resin, and the female terminals 50 received in the connector housing 36. This connector 35 is a male type connector for fitting into the socket 20 (FIG. 2). The connector housing 36 has a box-like shape, and has terminal receiving chambers 37 formed therein, and the terminals 50 are received respectively in these terminal receiving chambers. The connector housing 36 has an outer wall including a front wall 40, a rear wall 43 and a peripheral wall 45 of a square tubular shape interconnecting the front and rear walls 40 and 43, and openings 41 are formed through the front wall 40, and openings 44 are formed through the rear wall 43. A front end portion (in the fitting direction) of the peripheral wall 45 forms the male-type fitting portion for fitting into the connector fitting portion 30 of the socket 20.

In this embodiment, for description purposes, a forward-rearward direction X and an upward-downward direction Y will be defined as follows. The forward-rearward direction X is the direction of fitting of this connector into the socket 20, and the front side is that side for fitting into the socket 20, and the rear side is that side which faces away from the front side and from which wires 55 extend outwardly. The upward-downward direction Y is the direction of facing of the pair of retaining claws 46 (formed on the wall portion of the connector housing 36) away from each other, and the upper side is the left side in the drawings while the lower side is that side opposite to the upper side. The right-left direction (not shown) is the direction perpendicular to the forward-rearward direction and the upward-downward direction, that is, perpendicular to the sheet of the drawings. The forward-rearward direction X and the upward-downward direction Y are not defined in connection with actual use, and in actual use, the forward and rearward sides may be reversed, and the upper and lower sides may be inverted.

Referring again to FIG. 3, the terminal receiving chambers 37 are separated from each other by a partition walls, and are arranged to form two rows (only one of which is shown) juxtaposed in the right-left direction. The reason why the terminal receiving chambers 37 are arranged to form the two rows is that the bulb 10 of this embodiment is a type having the so-called single filament. In the case of a bulb 64, 74 (FIGS. 4 and 5) having two filaments 65 and 66 (75 and 76), terminal receiving chambers 37 are arranged to form three rows juxtaposed in the right-left direction. In the case where the number of terminal portions is four or more as in a bulb (not shown) having more than two filaments, terminal receiving chambers 37 can be arranged to form four or more rows in corresponding relation to the number of the terminal portions.

The terminal 50 is inserted into the terminal receiving chamber 37 through the opening 44 in the rear wall 43, and is received therein. A tapering face 44*a* is formed at an edge of the opening in the rear wall 43 so that the terminal 50 will not be caught by this edge during the insertion of the terminal. The terminal 50, thus inserted into the terminal receiving chamber 37, abuts against an inner face of the front wall 40, and therefore is positioned in the inserting direction.

The opening 41 in the front wall 40 serves also as an insertion hole for the insertion of the terminal portion 16*a*, 17*a* therethrough. A tapering guide face 41*a* is formed at an edge of the opening 41. The terminal portion 16*a*, 17*a* is guided by the guide face 41*a*, and is connected to the terminal 50.

When the terminal 50 is inserted into the terminal receiving chamber 37, a shoulder portion 51*a*, formed on an electrical contact portion 51, is engaged with a retaining projection 38 formed on the inner face of the terminal receiving chamber 37, so that the terminal is retained. When withdrawing the once inserted terminal 50, a withdrawal jig bar (not shown) is inserted through a small hole 42 formed through the front wall 40, and the engagement between the retaining projection 38 and the shoulder portion 51 a is canceled by a distal end of the withdrawal jig bar, and by doing so, the terminal 50 can be withdrawn.

The terminal 50 is formed by blanking a piece from an electrically-conductive metal sheet and then by bending this metal piece. The electrical contact portion 51 of a square tubular shape for the terminal portion 16*a*, 17*a* of the bulb 10 is formed at one end portion of the terminal, and a wire connection portion 53 is formed at the other end portion. A pair of upper and lower resilient contact piece portions 52*a* and 52*b* are formed within the electrical contact portion 51 so that a pressure of contact with the terminal portion 16*a*, 17*a* can be maintained, the upper resilient contact piece portion 52*a* being folded back rearwardly.

The wire connection portion 53 includes a pair of sheath-clamping piece portions 53*a* for press-clamping a wire sheath 56 of the wire 55, and a pair of conductor-clamping piece portions 53*b* for press-clamping a wire conductor 57 of the wire 55. The clamping piece portions 53*a* are spaced from the clamping piece portions 53*b* in the forward-rearward direction, and the clamping piece portions 53*a*, as well as the clamping piece portions 53*b*, are press-deformed into a generally B-shape, thereby press-fastening the terminal 50 to the wire 55.

Next, the operation for fitting the socket 20 on the connector 35 will be described.

First, the bulb 10 is mounted in the bulb mounting portion 23 of the socket 20, and the bulb 10 is held against withdrawal. On the other hand, the terminals 50, each having the wire, are inserted respectively into the terminal receiving chambers 37 through the respective openings 44, and the terminals 50 are held against withdrawal.

Then, the connector fitting portion 30 of the socket 20 is disposed in opposed relation to the fitting portion of the connector 35. Usually, the socket 20 is fixed to a mounting portion of a vehicle (not shown), and therefore the connector 35 is moved, and is inserted into the socket 20. When the connector 35 is pushed into the socket 20, the terminal portions 16*a* and 17*a* of the bulb 10 pass respectively through the openings 41 in the front wall 40, and are inserted into the terminals 50, respectively. Each terminal 16*a*, 17*a* advances inward while forcing the resilient contact piece portions 52*a* and 52*b* away from each other. When the inner wall of the socket 20 abuts against the front wall 40 of the connector 35, the advancing movement of the terminal portions 16*a* and 17*a* stops, and the electrically-connected condition of each terminal portion 16*a*, 17*a* and the corresponding terminal 50 is maintained, and the battery (not shown) and the bulb 10 are electrically connected together, so that the bulb 10 is lighted.

Figure 4:
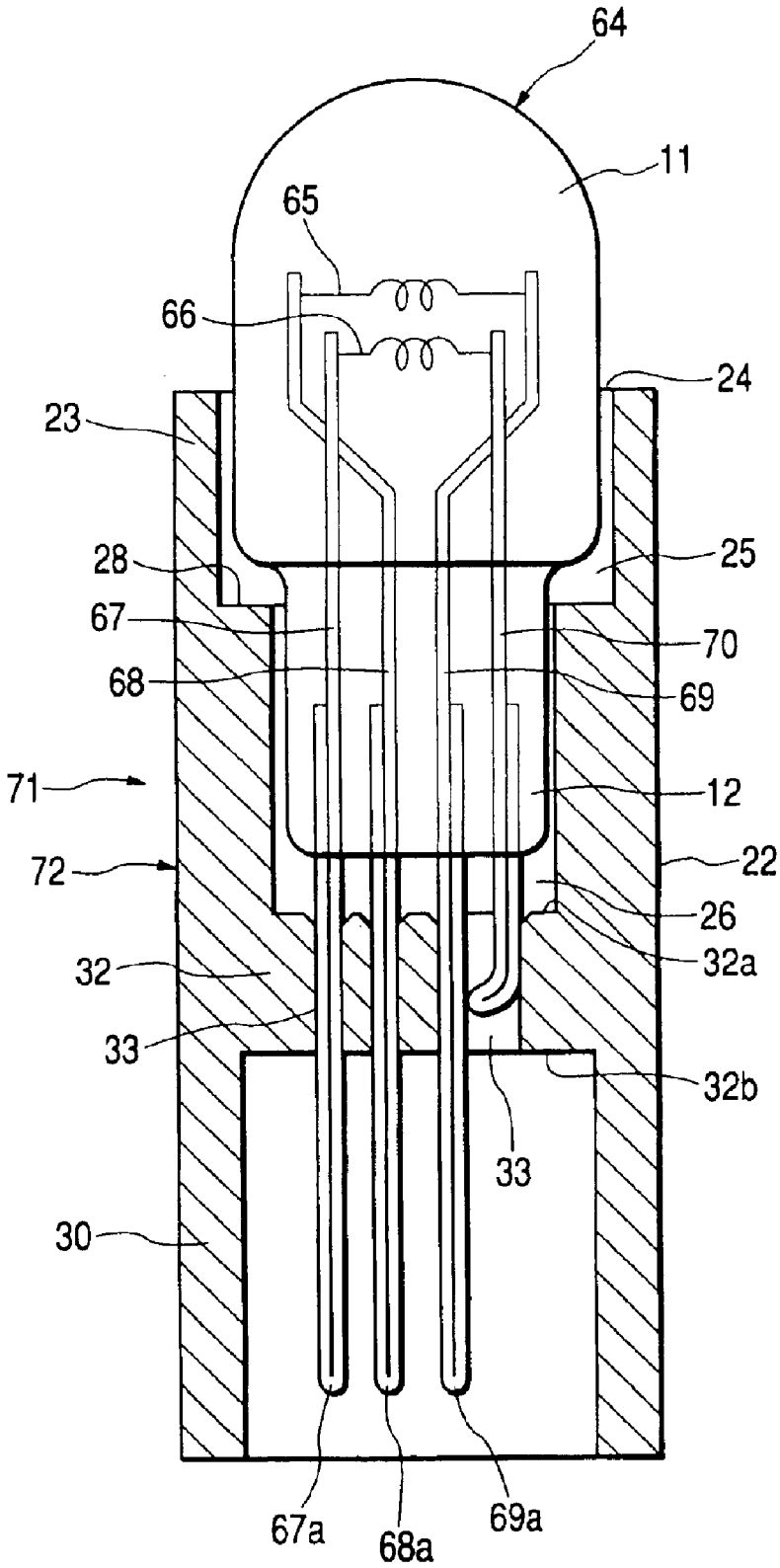
FIG. 4 shows a connecting structure of bulb according to a second embodiment of the present invention, and is a cross-sectional view of a socket in which a bulb is mounted.

FIG. 4 shows a connecting structure of bulb according to the second embodiment of the invention. Identical constituent portions of this embodiment to those of the first embodiment will be designated by identical reference numerals, respectively, and explanation thereof will be omitted. This embodiment differs from the first embodiment in that a bulb 64 has two filaments 65 and 66 and that two lead wires 69 and 70 for connection to a negative electrode of a battery (not shown) are directly contacted with each other to form a single-pole terminal portion 69*a*.

In order to change the luminous intensity, two kinds of filaments 65 and 66 of different wattages are used. This bulb 64 can emit beams of different divergent angles (for example, a low beam and a high beam of a headlamp) by switching the illumination between the filaments 65 and 66.

Four lead wires 67, 68, 69 and 70 are connected to opposite ends of the filaments 65 and 66, respectively. The two lead wires 67 and 68 are connected to a positive electrode of the battery, while the other two lead wires 69 and 70 are connected to the negative electrode of the battery. Terminal portions 67*a* and 68*a* are formed respectively at extension portions of the two positive electrode-side lead wires 67 and 68. In order that the two negative electrode-side lead wires 69 and 70 can jointly form the single-pole terminal portion 69*a*, one lead wire 70 is bent inwardly to contact the other lead wire 69.

Heretofore, two lead terminals (not shown), connected to a negative electrode, have been connected together through a relay terminal (not shown), provided in a socket, to form a single-pole terminal portion, and therefore there have been encountered problems that the structure of the socket is complicated and that the number of the component parts increases, so that the cost is high. In this embodiment, however, the single-pole terminal 69*a* for connection to the negative electrode can be formed without providing any relay terminal in the socket 20, and therefore the structure of the socket 20 is simplified, and the number of the component parts is reduced, so that the cost can be reduced.

Unlike the socket 20 of the first embodiment, a socket 71 is molded in such a manner that the terminal portions 67*a*, 68*a* and 69*a*, forming the three poles, project into the interior of a connector fitting portion 30. Unlike the connector 35 of the first embodiment, a connector (not shown) for fitting into the socket portion 71 is of such a construction that female terminals, forming three poles, are arranged in a juxtaposed manner.

Figure 5:
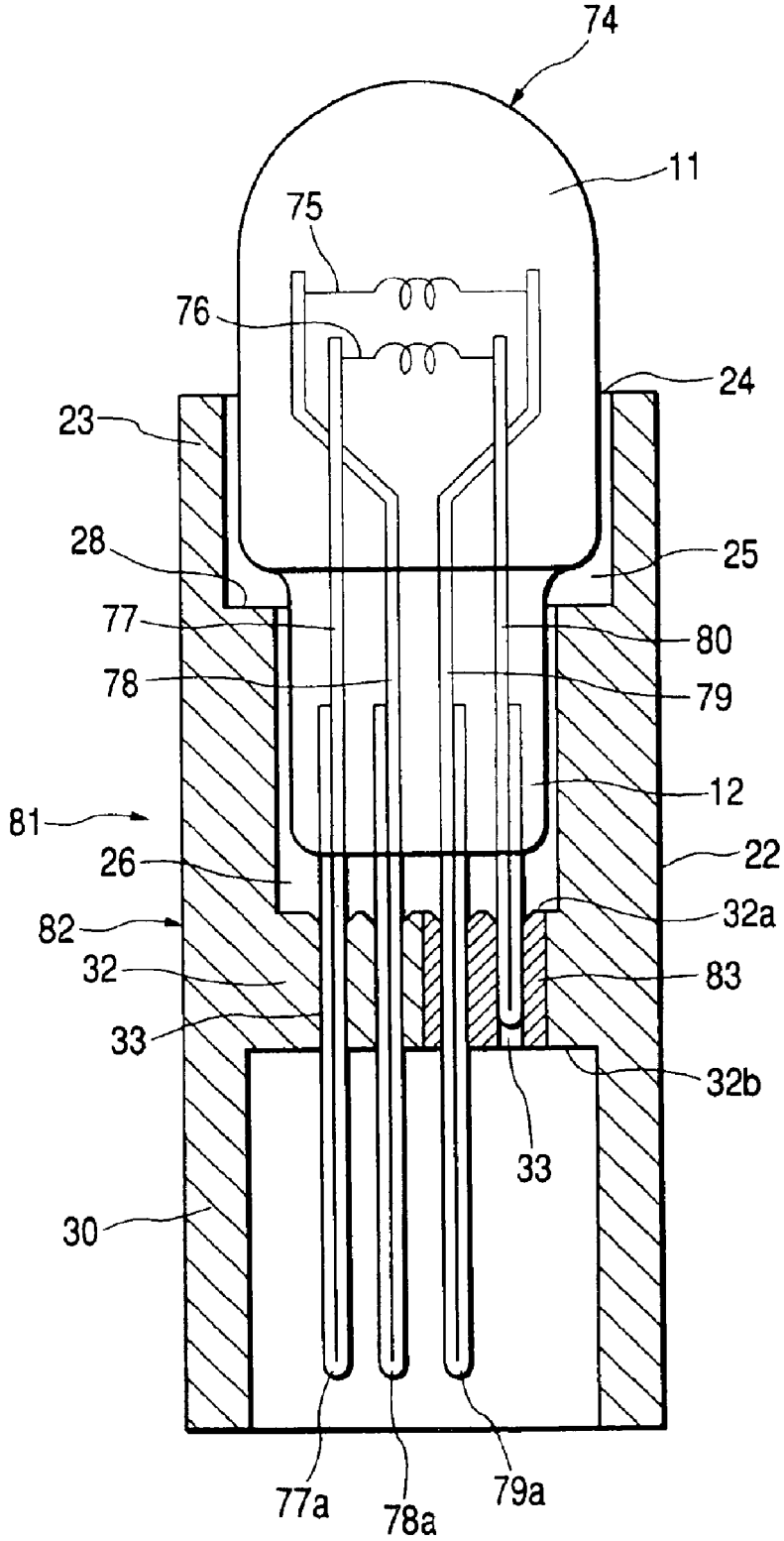
FIG. 5 shows a connecting structure of bulb according to a third embodiment of the present invention, and is a cross-sectional view of a socket in which a bulb is mounted.

FIG. 5 shows a connecting structure of bulb according to the third embodiment of the invention. This embodiment differs from the first embodiment in that a bulb 74 has two filaments 75 and 76 and that two lead wires 79 and 80 for connection to a negative electrode of a battery are contacted with each other through an electrically-connecting portion 83 to form a single-pole terminal portion 79*a* as in the second embodiment.

Those portions of the two negative electrode-side lead wires 79 and 80, extending outwardly from a base portion 12 of the bulb 74, are different in length from each other. One lead wire 79 has the same length as that of positive electrode-side lead wires 77 and 78, while the other lead wire 80 is shorter than a half of the one lead wire 79. Besides the lead wire 80 has such a length that its end portion is embedded in a partition wall 32, and does not project from the partition wall 32 into the interior of a connector fitting portion 30.

The electrically-connecting portion 83, electrically connecting the two lead wires 79 and 80 together, is provided at that portion of the partition wall 32 into which the two negative electrode-side lead wires 79 and 80 extend. The electrically-connecting portion 83 may be formed by insert molding of an electrically-conductive metal piece or may be formed by forming an electrically-conductive resin integrally with the partition wall. The electrically-connecting portion 83 electrically connect the two negative electrode-side lead wires 79 and 80 together, so that the single-pole negative terminal portion 79*a* can be formed. Therefore it is not necessary to provide a relay terminal on an inside of the socket 81, and thereof the structure of the socket is simplified.

The other constituent portions are similar to those of the above embodiments, and therefore explanation thereof will be omitted.

Figure 6:
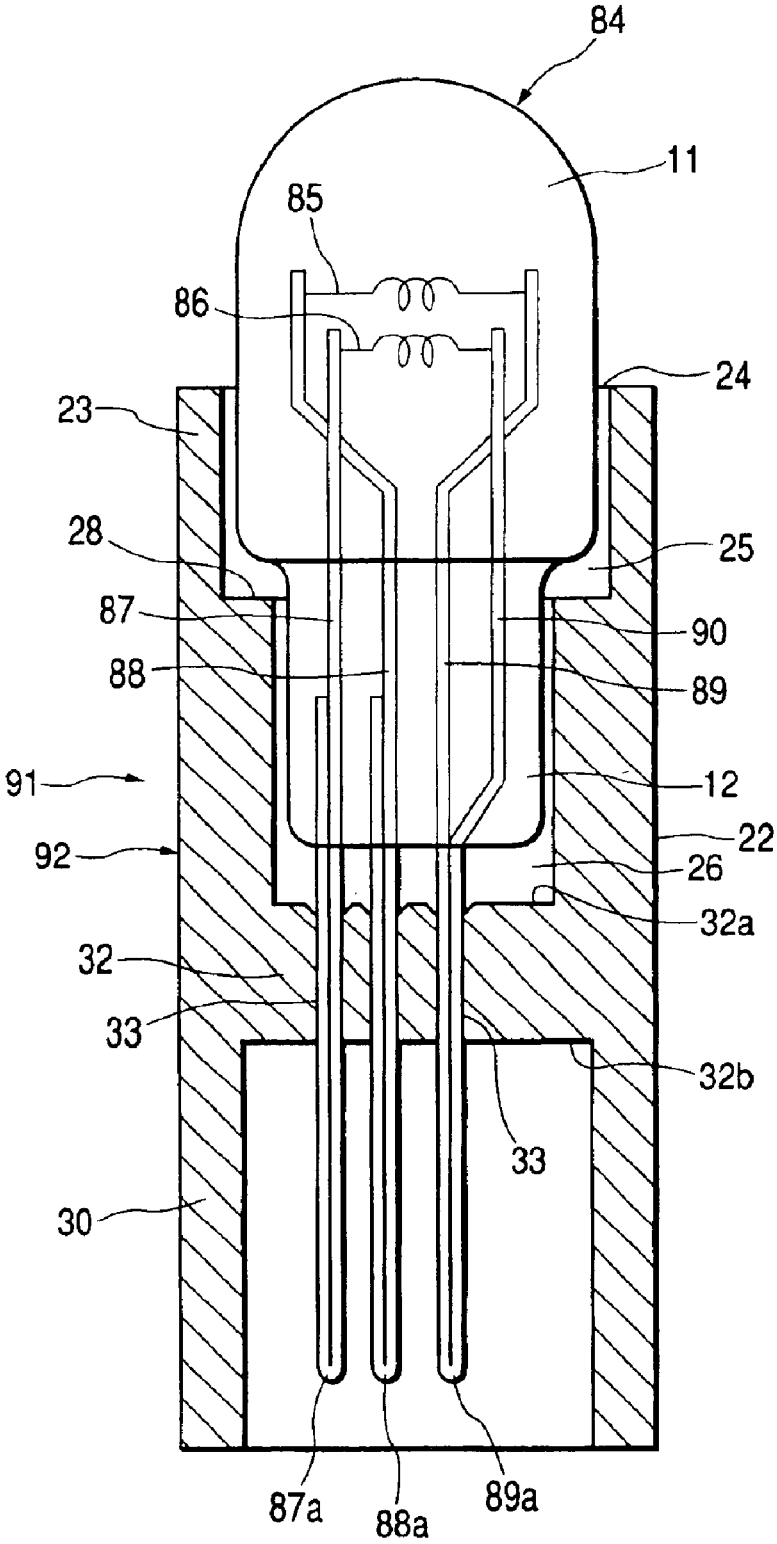
FIG. 6 shows a connecting structure of bulb according to a fourth embodiment of the present invention, and is a cross-sectional view of a socket in which a bulb is mounted.
Figure 7:
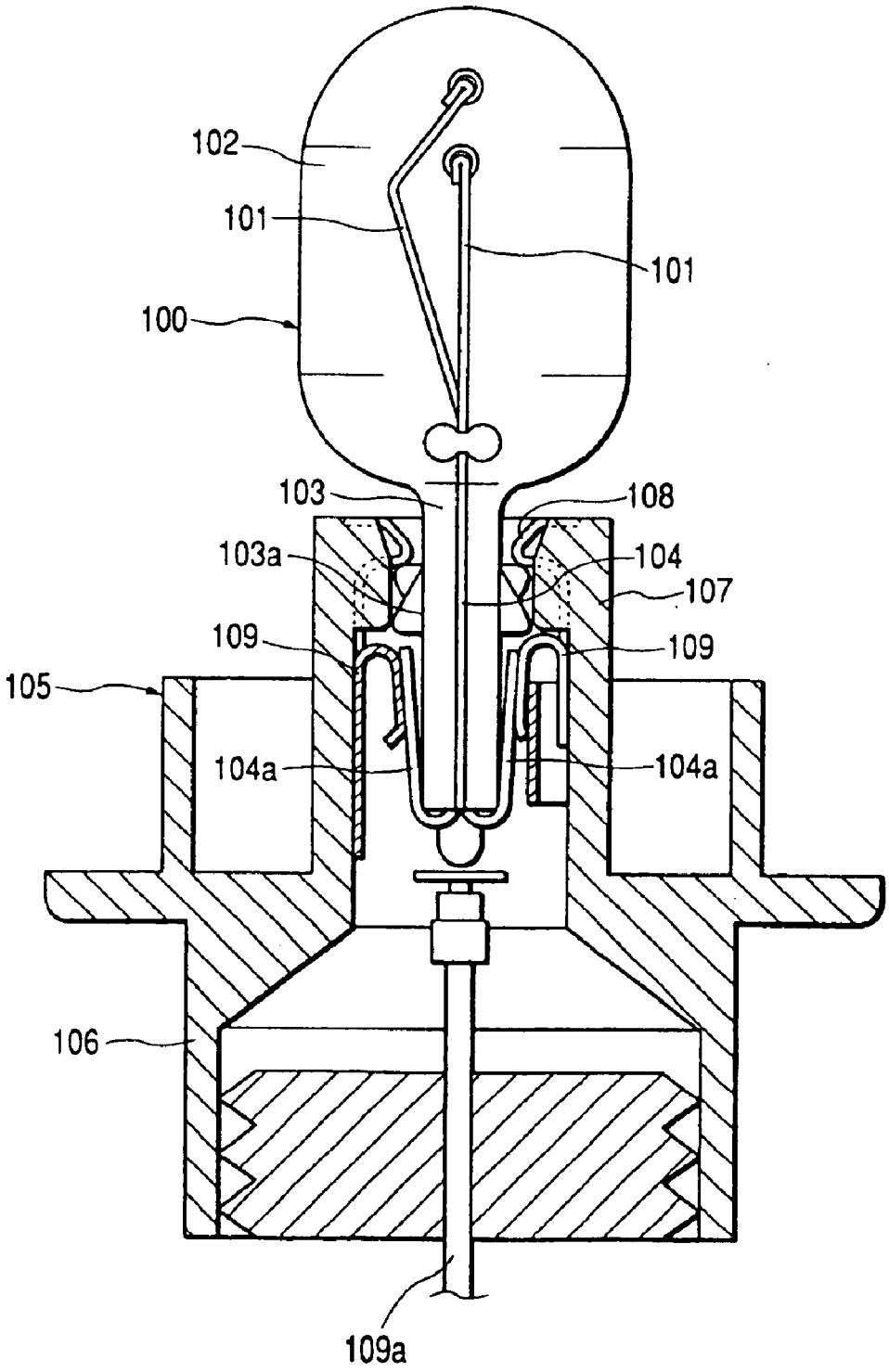
FIG. 7 PRIOR ART
FIG. 7 is a cross-sectional view of one related connecting structure of bulb.
Figure 8:
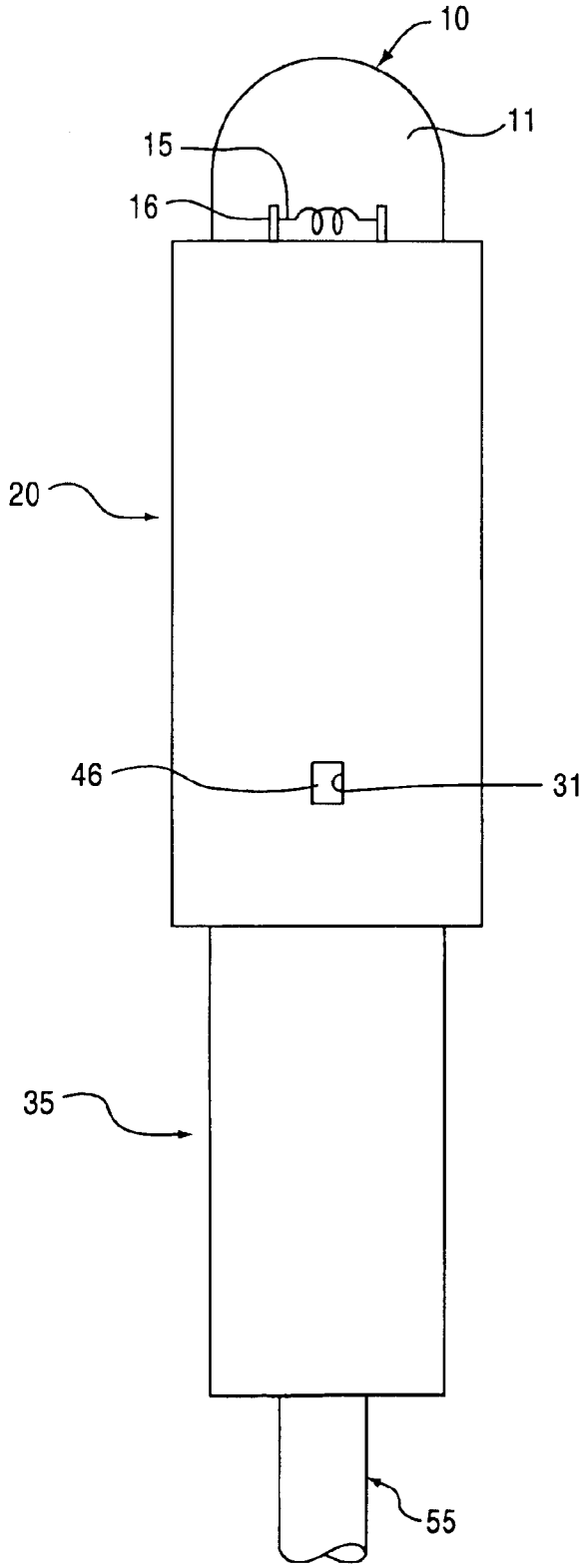
FIG. 8 shows the socket joined to the mating connector.

FIG. 6 shows a connecting structure of bulb according to the fourth embodiment of the invention. This embodiment differs from the first embodiment in that a bulb 84 has two filaments 85 and 86 and that two lead wires 89 and 90 for connection to a negative electrode of a battery are connected together to form a single lead wire as in the second and third embodiments.

Namely, end portions of the two lead wires 89 and 90 are formed into a single-pole terminal portion 89*a* defined by a lead wire portion which is folded back upon itself. This terminal portion 89*a* is identical in shape and length to the other two terminal portions 87*a* and 88*a* forming two poles.

In this embodiment, the two lead wires 89 and 90 are connected together at their ends, and therefore incomplete contact between the lead wires 89 and 90 is prevented, and the reliability of the electrical connection can be enhanced. And besides, only three passage holes 33, 33 and 33 need to be formed through a partition wall 32 of a socket 91, and therefore the structure of the socket 91 is simplified, and the molding cost is reduced.

The other constituent portions of the socket 91 and the construction of a connector 35 for fitting into the socket 91 are similar to those of the above embodiments, and therefore explanation thereof will be omitted.

What is claimed is:

1. A connecting structure, comprising:

an electric bulb, having a first filament;

a socket, including;

a bulb mounting portion, in which the electric bulb is mounted therein;

a connector fitting portion, into which a connector is fitted; and a partition wall, having at least one passage hole which communicates the bulb mounting portion with the connector fitting portion, the partition wall being located between the bulb mounting portion and the connector fitting portion;

a connector, having at least one terminal therein, and the connector fitting into the connector fitting portion of the socket;

a first lead wire and a second lead wire, connected respectively to both ends of the first filament of the electric bulb, the first lead wire extending from the first filament through the at least one passage hole to the connector fitting portion and then back through the at least one passage hole and terminating inside the base portion, the first lead wire in the connector fitting portion being folded back so as to superpose folded portion thereof;

wherein the portions of the first lead wire and the second lead wire which are located in the connector fitting portion correspond to the terminal portions, wherein the terminal portions are connected to the at least one terminal when the socket is fitted on the connector.

2. The connecting structure as set forth in claim 1, wherein the bulb further includes a second filament;

wherein a third lead wire and a fourth lead wire are connected respectively to both ends of the second filament of the electric bulb; and wherein the second lead wire and the fourth lead wire are connected respectively to a negative electrode of a power source, and the second lead wire and the fourth lead wire are directly connected each other.

3. The connecting structure as set forth in claim 1, wherein a conductive portion is formed in the socket;

wherein the bulb further includes a second filament;

wherein a third lead wire and a fourth lead wire are connected respectively to both ends of the second filament of the electric bulb; and wherein the second lead wire and the fourth lead wire are connected respectively to a negative electrode of a power source, and the second lead wire and the fourth lead wire are electrically connected through the conductive portion.

4. The connecting structure as set forth in claim 1, wherein the bulb further includes a second filament, wherein a third lead wire and a fourth lead wire are connected respectively to both ends of the second filament of the electric bulb; and wherein the second lead wire and the fourth lead wire are connected respectively to a negative electrode of a power source, and the second lead wire and the fourth lead wire are formed by a single lead wire.

5. The connecting structure as set forth in claim 1, wherein a retaining portion is provided at a base portion of the bulb from which the lead wires extend outwardly;

wherein an engagement portion is provided at the socket; and wherein the engagement portion is engaged with the retaining portion so that the bulb is held in the socket.

6. The connecting structure as set forth in claim 1, wherein a retaining portion is provided at the socket;

wherein a engagement portion is provided at the connector; and wherein the engagement portion is engaged with the retaining portion so that the socket and the connector are held in the fitted condition.

7. The connecting structure as set forth in claim 1, wherein at least one of the first lead wire and the second lead wire is folded back so as to superpose folded portions thereof.

8. The connecting structure as set forth in claim 2, wherein at least one of the third lead wire and the fourth lead wire is folded back so as to superpose folded portions thereof.

9. The connecting structure as set forth in claim 3, wherein at least one of the third lead wire and the fourth lead wire is folded back so as to superpose folded portions thereof.

10. The connecting structure as set forth in claim 4, wherein at least one of the third lead wire and the fourth lead wire is folded back so as to superpose folded portions thereof.

* * * * *